US009111543B2

(12) United States Patent
Åhgren

(10) Patent No.: US 9,111,543 B2
(45) Date of Patent: Aug. 18, 2015

(54) PROCESSING SIGNALS

(75) Inventor: Per Åhgren, Stockholm (SE)

(73) Assignee: Skype, Dublin (IE)

( * ) Notice: Subject to any disclaimer, the term of this patent is extended or adjusted under 35 U.S.C. 154(b) by 604 days.

(21) Appl. No.: 13/327,308

(22) Filed: Dec. 15, 2011

(65) Prior Publication Data

US 2013/0136274 A1 May 30, 2013

(30) Foreign Application Priority Data

Nov. 25, 2011 (GB) ..... 1120392.4

(51) Int. Cl.

| | |
|---|---|
| ***H04R 3/00*** | (2006.01) |
| ***G10L 21/02*** | (2013.01) |
| *G10L 21/0216* | (2013.01) |
| *G10L 21/0208* | (2013.01) |

(52) U.S. Cl.

CPC ..... *G10L 21/02* (2013.01); *H04R 3/005* (2013.01); *G10L 2021/02082* (2013.01); *G10L 2021/02166* (2013.01); *H04R 2430/20* (2013.01)

(58) Field of Classification Search

CPC .... H04R 3/005; H04R 2430/20; H04R 1/406; H04R 25/407; H04R 3/00; G10L 21/02; G10L 2021/02082; G10L 2021/02166; G10L 21/0208

USPC ..... 381/92, 122, 94.1, 91, 94.7, 313, 71.1, 381/94.2, 56, 66, 94.3; 704/205, 225, 226

See application file for complete search history.

(56) References Cited

U.S. PATENT DOCUMENTS

| | | | |
|---|---|---|---|
| 4,849,764 | A | 7/1989 | van Heyningen |
| 5,208,864 | A | 5/1993 | Kaneda |
| 5,524,059 | A | 6/1996 | Zurcher |
| 6,157,403 | A | 12/2000 | Nagata |
| 6,232,918 | B1 | 5/2001 | Wax et al. |
| 6,339,758 | B1 | 1/2002 | Kanazawa et al. |
| 6,914,854 | B1 | 7/2005 | Heberley et al. |
| 8,249,862 | B1 | 8/2012 | Cheng et al. |

(Continued)

FOREIGN PATENT DOCUMENTS

| | | |
|---|---|---|
| CA | 2413217 | 5/2004 |
| CN | 100446530 | 3/2001 |

(Continued)

OTHER PUBLICATIONS

"Search Report", GB Application No. 1108885.3, (Sep. 3, 2012), 3 pages.

(Continued)

*Primary Examiner* — Paul S Kim

(74) *Attorney, Agent, or Firm* — Jim Ross; Micky Minhas

(57) ABSTRACT

Method, device and computer program product for processing signals. Signals are received at a plurality of sensors of the device. The initiation of a signal state in which signals of a particular type are received at the plurality of sensors is determined. Responsive to the determining of the initiation of the signal state, data indicating beamformer coefficients to be applied by a beamformer of the device is retrieved from data storage means, wherein the indicated beamformer coefficients are determined so as to be suitable for application to signals received at the sensors in the signal state. The beamformer applies the indicated beamformer coefficients to the signals received at the sensors in the signal state, thereby generating a beamformer output.

26 Claims, 6 Drawing Sheets

(56) References Cited

U.S. PATENT DOCUMENTS

| | | | | |
|---|---|---|---|---|
| 8,325,952 | B2 | 12/2012 | Cho | |
| 8,401,178 | B2 | 3/2013 | Chen et al. | |
| 8,620,388 | B2 | 12/2013 | Hayakawa et al. | |
| 8,824,693 | B2 | 9/2014 | Ahgren | |
| 8,891,785 | B2 | 11/2014 | Sorensen | |
| 8,981,994 | B2 | 3/2015 | Sorenson | |
| 9,031,257 | B2 | 5/2015 | Sorensen et al. | |
| 9,042,573 | B2 | 5/2015 | Sorensen | |
| 9,042,574 | B2 | 5/2015 | Sorensen | |
| 9,042,575 | B2 | 5/2015 | Sorensen | |
| 2002/0015500 | A1 | 2/2002 | Belt et al. | |
| 2002/0103619 | A1 | 8/2002 | Bizjak | |
| 2002/0171580 | A1 | 11/2002 | Gaus et al. | |
| 2004/0125942 | A1 | 7/2004 | Beaucoup et al. | |
| 2004/0213419 | A1 | 10/2004 | Varma et al. | |
| 2005/0149339 | A1 | 7/2005 | Tanaka et al. | |
| 2005/0216258 | A1 | 9/2005 | Kobayashi et al. | |
| 2005/0232441 | A1 | 10/2005 | Beaucoup et al. | |
| 2006/0015331 | A1 | 1/2006 | Hui et al. | |
| 2006/0031067 | A1 | 2/2006 | Kaminuma | |
| 2006/0133622 | A1 | 6/2006 | Chen | |
| 2006/0153360 | A1 | 7/2006 | Kellermann et al. | |
| 2006/0269073 | A1 | 11/2006 | Mao | |
| 2007/0164902 | A1 | 7/2007 | Bang et al. | |
| 2008/0039146 | A1 | 2/2008 | Jin | |
| 2008/0199025 | A1 | 8/2008 | Amada | |
| 2008/0232607 | A1 | 9/2008 | Tashev et al. | |
| 2008/0260175 | A1 | 10/2008 | Elko | |
| 2009/0010453 | A1 | 1/2009 | Zurek et al. | |
| 2009/0076810 | A1 | 3/2009 | Matsuo | |
| 2009/0076815 | A1 | 3/2009 | Ichikawa et al. | |
| 2009/0125305 | A1 | 5/2009 | Cho | |
| 2009/0274318 | A1 | 11/2009 | Ishibashi et al. | |
| 2009/0304211 | A1 | 12/2009 | Tashev et al. | |
| 2010/0014690 | A1 | 1/2010 | Wolff et al. | |
| 2010/0027810 | A1 | 2/2010 | Marton | |
| 2010/0070274 | A1 | 3/2010 | Cho et al. | |
| 2010/0081487 | A1 | 4/2010 | Chen et al. | |
| 2010/0103776 | A1 | 4/2010 | Chan | |
| 2010/0128892 | A1 | 5/2010 | Chen et al. | |
| 2010/0150364 | A1 | 6/2010 | Buck et al. | |
| 2010/0177908 | A1 | 7/2010 | Seltzer et al. | |
| 2010/0215184 | A1 | 8/2010 | Buck et al. | |
| 2010/0217590 | A1 | 8/2010 | Nemer et al. | |
| 2010/0246844 | A1 | 9/2010 | Wolff et al. | |
| 2010/0296665 | A1 | 11/2010 | Ishikawa et al. | |
| 2010/0315905 | A1 | 12/2010 | Lee et al. | |
| 2010/0323652 | A1 | 12/2010 | Visser et al. | |
| 2011/0038486 | A1 | 2/2011 | Beaucoup | |
| 2011/0038489 | A1 | 2/2011 | Visser et al. | |
| 2011/0054891 | A1 | 3/2011 | Vitte et al. | |
| 2011/0070926 | A1 | 3/2011 | Vitte et al. | |
| 2011/0158418 | A1 | 6/2011 | Bai et al. | |
| 2011/0178798 | A1* | 7/2011 | Flaks et al. | 704/226 |
| 2012/0182429 | A1 | 7/2012 | Forutanpour et al. | |
| 2012/0303363 | A1 | 11/2012 | Sorensen | |
| 2013/0013303 | A1 | 1/2013 | Strommer et al. | |
| 2013/0034241 | A1 | 2/2013 | Pandey et al. | |
| 2013/0082875 | A1 | 4/2013 | Sorensen | |
| 2013/0083832 | A1 | 4/2013 | Sorensen | |
| 2013/0083934 | A1 | 4/2013 | Åhgren | |
| 2013/0083936 | A1 | 4/2013 | Sorensen | |
| 2013/0083942 | A1 | 4/2013 | Åhgren et al. | |
| 2013/0083943 | A1 | 4/2013 | Sorensen et al. | |
| 2013/0129100 | A1 | 5/2013 | Sorensen | |
| 2013/0148821 | A1 | 6/2013 | Sorensen | |

FOREIGN PATENT DOCUMENTS

| | | |
|---|---|---|
| CN | 1406066 | 3/2003 |
| CN | 1698395 | 11/2005 |
| CN | 1809105 | 7/2006 |
| CN | 1815918 | 8/2006 |
| CN | 1835416 | 9/2006 |
| CN | 1885848 | 12/2006 |
| CN | 101015001 | 8/2007 |
| CN | 101018245 | 8/2007 |
| CN | 101207663 | 6/2008 |
| CN | 100407594 | 7/2008 |
| CN | 101278596 | 10/2008 |
| CN | 101455093 | 6/2009 |
| CN | 101625871 | 1/2010 |
| CN | 101667426 | 3/2010 |
| CN | 101685638 | 3/2010 |
| CN | 101828410 | 9/2010 |
| CN | 102111697 | 6/2011 |
| CN | 102131136 | 7/2011 |
| CN | 1540903 | 10/2014 |
| DE | 19943872 | 3/2001 |
| EP | 0002222 | 6/1979 |
| EP | 0654915 | 5/1995 |
| EP | 1722545 | 11/2006 |
| EP | 1919251 | 5/2008 |
| EP | 1930880 | 6/2008 |
| EP | 2026329 | 2/2009 |
| EP | 2159791 | 3/2010 |
| EP | 2175446 | 4/2010 |
| EP | 2197219 | 6/2010 |
| EP | 2222091 | 8/2010 |
| EP | 2339574 | 6/2011 |
| JP | 2006109340 | 4/2006 |
| JP | 2006319448 | 11/2006 |
| JP | 2006333069 | 12/2006 |
| JP | 2010232717 | 10/2010 |
| TW | 201123175 | 7/2011 |
| WO | WO-0018099 | 3/2000 |
| WO | WO-03010996 | 2/2003 |
| WO | WO-2007127182 | 11/2007 |
| WO | WO-2008041878 | 4/2008 |
| WO | WO-2008062854 | 5/2008 |
| WO | WO-2010098546 | 9/2010 |
| WO | WO-2012097314 | 7/2012 |

OTHER PUBLICATIONS

"Search Report", GB Application No. 1111474.1, (Oct. 24, 2012), 3 pages.

"Search Report", GB Application No. 1116847.3, (Dec. 20, 2012), 3 pages.

"PCT Search Report and Written Opinion", Application No. PCT/US2012/2065737, (Feb. 13, 2013), 12 pages.

"PCT Search Report and Written Opinion", Application No. PCT/US/2012/045556, (Jan. 2, 2013), 10 pages.

"International Search Report and Written Opinion", Application No. PCT/US2012/058146, (Jan. 21, 2013), 9 pages.

"International Search Report and Written Opinion", Application No. PCT/2012/066485, (Feb. 15, 2013), 12 pages.

"Non-Final Office Action", U.S. Appl. No. 13/341,610, Dec. 27, 2013, 10 pages.

"Non-Final Office Action", U.S. Appl. No. 13/307,994, Dec. 19, 2013, 12 pages.

"Non-Final Office Action", U.S. Appl. No. 13/307,852, Feb. 20, 2014, 5 pages.

"Search Report", GB Application No. 1119932.0, Feb. 28, 2013, 8 pages.

"Foreign Office Action", CN Application No. 201210368101.5, Dec. 6, 2013, 9 pages.

"Search Report", Application No. GB1116846.5, Jan. 28, 2013, 3 pages.

"Search Report", GB Application No. 1116840.8, Jan. 29, 2013, 3 pages.

"Search Report", GB Application No. 1116843.2, Jan. 30, 2013, 3 pages.

"Search Report", GB Application No. 1116869.7, Feb. 7, 2013, 3 pages.

"Search Report", GB Application No. 1121147.1, Feb. 14, 2013, 5 pages.

"UK Search Report", UK Application No. GB1116848.1, Dec. 18, 2012, 3 pages.

(56) References Cited

OTHER PUBLICATIONS

"International Search Report and Written Opinion", Application No. PCT/US2013/058144, (Sep. 11, 2013),10 pages.
"Non-Final Office Action", U.S. Appl. No. 13/212,633, (Nov. 1, 2013),14 pages.
"Non-Final Office Action", U.S. Appl. No. 13/212,688, (Nov. 7, 2013),14 pages.
Knapp, et al., "The Generalized Correlation Method for Estimation of Time Delay", *IEEE Transactions on Acoustics, Speech, and Signal Processing*, vol. ASSP-24, No. 4, (Aug. 1976), pp. 320-327.
"PCT Search Report and Written Opinion", Application No. PCT/US2012/068649, (Mar. 7, 2013), 9 pages.
"PCT Search Report and Written Opinion", Application No. PCT/US2012/058145, (Apr. 24, 2013),18 pages.
"PCT Search Report and Written Opinion", Application No. PCT/US2012/058148, (May 3, 2013), 9 pages.
"PCT Search Report and Written Opinion", Application No. PCT/US2012/058147, (May 8, 2013),9 pages.
"PCT Search Report and Written Opinion", Application No. PCT/US2012/058143, (Dec. 21, 2012),12 pages.
Goldberg, et al., "Joint Direction-of-Arrival and Array Shape Tracking for Multiple Moving Targets", *IEEE International Conference on Acoustics, Speech, and Signal Processing*, (Apr. 21, 1997), pp. 511-514.
Grbic, Nedelko et al., "Soft Constrained Subband Beamforming for Hands-Free Speech Enhancement", *In Proceedings of ICASSP 2002*, (May 13, 2002), 4 pages.
Handzel, et al., "Biomimetic Sound-Source Localization", *IEEE Sensors Journal*, vol. 2, No. 6, (Dec. 2002), pp. 607-616.
Kellerman, W. "Strategies for Combining Acoustic Echo Cancellation and Adaptive Beamforming Microphone Arrays", *In Proceedings of ICASSP 1997*, (Apr. 1997), pp. 219-222.
"Foreign Office Action", CN Application No. 201210367888.3, Jul. 15, 2014, 13 pages.
"Foreign Office Action", CN Application No. 201210368101.5, Jun. 20, 2014, 7 pages.
"Foreign Office Action", CN Application No. 201210377215.6, Mar. 24, 2014, 16 pages.
"Foreign Office Action", CN Application No. 201210462710.7, Mar. 5, 2014, 12 pages.
"Non-Final Office Action", U.S. Appl. No. 13/327,250, Sep. 15, 2014, 10 pages.
"Notice of Allowance", U.S. Appl. No. 13/307,852, Sep. 12, 2014, 4 pages.
"Final Office Action", U.S. Appl. No. 13/341,610, Jul. 17, 2014, 7 pages.
"Foreign Office Action", CN Application No. 201210368224.9, Jun. 5, 2014, 11 pages.
"Non-Final Office Action", U.S. Appl. No. 13/308,165, Jul. 17, 2014, 14 pages.
"Non-Final Office Action", U.S. Appl. No. 13/308,210, Aug. 18, 2014, 6 pages.
"Supplemental Notice of Allowance", U.S. Appl. No. 13/307,994, Aug. 8, 2014, 2 pages.
"Corrected Notice of Allowance", U.S. Appl. No. 13/307,994, Jun. 24, 2014, 2 pages.
"Final Office Action", U.S. Appl. No. 13/212,633, May 23, 2014, 16 pages.
"Final Office Action", U.S. Appl. No. 13/212,688, Jun. 5, 2014, 20 pages.
"Foreign Office Action", CN Application No. 201210377130.8, Jan. 15, 2014, 12 pages.
"International Search Report and Written Opinion", Application No. PCT/EP2012/059937, Feb. 14, 2014, 9 pages.
"Non-Final Office Action", U.S. Appl. No. 13/307,852, May 16, 2014, 4 pages.
"Notice of Allowance", U.S. Appl. No. 13/307,994, Apr. 1, 2014, 7 pages.
"Notice of Allowance", U.S. Appl. No. 13/308,106, Jun. 27, 2014, 7 pages.
"Corrected Notice of Allowance", U.S. Appl. No. 13/307,852, Feb. 20, 2015, 2 pages.
"Corrected Notice of Allowance", U.S. Appl. No. 13/307,852, Dec. 18, 2014, 2 pages.
"Corrected Notice of Allowance", U.S. Appl. No. 13/308,165, Feb. 17, 2015, 2 pages.
"Corrected Notice of Allowance", U.S. Appl. No. 13/308,210, Feb. 17, 2015, 2 pages.
"Foreign Notice of Allowance", CN Application No. 201210368224.9, Jan. 6, 2015, 3 pages.
"Foreign Notice of Allowance", CN Application No. 201210377130.8, Jan. 17, 2015, 3 pages.
"Foreign Notice of Allowance", CN Application No. 201210462710.7, Jan. 6, 2015, 6 pages.
"Foreign Office Action", CN Application No. 201210377215.6, Jan. 23, 2015, 11 pages.
"Foreign Office Action", CN Application No. 201280043129.X, Dec. 17, 2014, 8 pages.
"Foreign Office Action", EP Application No. 12809381.2, Feb. 9, 2015, 8 pages.
"Foreign Office Action", EP Application No. 12878205.9, Feb. 9, 2015, 6 pages.
"Foreign Office Action", GB Application No. 1121147.1, Apr. 25, 2014, 2 pages.
"Non-Final Office Action", U.S. Appl. No. 13/212,633, Nov. 28, 2014, 16 pages.
"Non-Final Office Action", U.S. Appl. No. 13/212,688, Feb. 27, 2015, 23 pages.
"Notice of Allowance", U.S. Appl. No. 13/308,165, Dec. 23, 2014, 7 pages.
"Notice of Allowance", U.S. Appl. No. 13/308,210, Dec. 16, 2014, 6 pages.
"Notice of Allowance", U.S. Appl. No. 13/327,250, Jan. 5, 2015, 9 pages.
"Notice of Allowance", U.S. Appl. No. 13/341,610, Dec. 26, 2014, 8 pages.
"Foreign Office Action", CN Application No. 201210377115.3, Aug. 27, 2014, 18 pages.
"Foreign Office Action", CN Application No. 201210377130.8, Sep. 28, 2014, 7 pages.
"Foreign Office Action", CN Application No. 201210485807.X, Oct. 8, 2014, 10 pages.
"Foreign Office Action", CN Application No. 201210521742.X, Oct. 8, 2014, 16 pages.
"Supplemental Notice of Allowance", U.S. Appl. No. 13/307,852, Oct. 22, 2014, 2 pages.
Goldberg, et al., "Joint Direction-of-Arrival and Array-Shape Tracking for Multiple Moving Targets", IEEE International Conference on Acoustic, Speech, and Signal Processing, Apr. 25, 1997, 4 pages.
"Non-Final Office Action", U.S. Appl. No. 13/341,607, Mar. 27, 2015, 10 pages.
"Foreign Office Action", EP Application No. 12784776.2, Jan. 30, 2015, 6 pages.
"Final Office Action", U.S. Appl. No. 13/212,633, May 21, 2015, 16 pages.
"Foreign Office Action", CN Application No. 201210377115.3, Apr. 23, 2015, 12 pages.
"Foreign Office Action", CN Application No. 201210485807.X, Jun. 15, 2015, 7 pages.

* cited by examiner

PROCESSING SIGNALS

RELATED APPLICATION

This application claims priority under 35 U.S.C. §119 or 365 to Great Britain, Application No. GB 1120392.4, filed Nov. 25, 2011.

The entire teachings of the above application are incorporated herein by reference.

TECHNICAL FIELD

The present invention relates to processing signals received at a device.

BACKGROUND

A device may have input means that can be used to receive transmitted signals from the surrounding environment. For example, a device may have audio input means such as a microphone that can be used to receive audio signals from the surrounding environment. For example, a microphone of a user device may receive a primary audio signal (such as speech from a user) as well as other audio signals. The other audio signals may be interfering (or "undesired") audio signals received at the microphone of the device, and may be received from an interfering source or may be ambient background noise or microphone self-noise. The interfering audio signals may disturb the primary audio signals received at the device. The device may use the received audio signals for many different purposes. For example, where the received audio signals are speech signals received from a user, the speech signals may be processed by the device for use in a communication event, e.g. by transmitting the speech signals over a network to another device which may be associated with another user of the communication event. Alternatively, or additionally, the received audio signals could be used for other purposes, as is known in the art.

In other examples, a device may have receiving means for receiving other types of transmitted signals, such as radar signals, sonar signals, antenna signals, radio waves, microwaves and general broadband signals or narrowband signals. The same situations can occur for these other types of transmitted signals whereby a primary signal is received as well as interfering signals at the receiving means. The description below is provided mainly in relation to the receipt of audio signals at a device, but the same principles will apply for the receipt of other types of transmitted signals at a device, such as general broadband signals, general narrowband signals, radar signals, sonar signals, antenna signals, radio waves and microwaves as described above.

In order to improve the quality of the received audio signals, (e.g. the speech signals received from a user for use in a call), it is desirable to suppress interfering audio signals (e.g. background noise and interfering audio signals received from interfering audio sources) that are received at the microphone of the user device.

The use of stereo microphones and other microphone arrays in which a plurality of microphones operate as a single audio input means is becoming more common. The use of a plurality of microphones at a device enables the use of extracted spatial information from the received audio signals in addition to information that can be extracted from an audio signal received by a single microphone. When using such devices one approach for suppressing interfering audio signals is to apply a beamformer to the audio signals received by the plurality of microphones. Beamforming is a process of focusing the audio signals received by a microphone array by applying signal processing to enhance particular audio signals received at the microphone array from one or more desired locations (i.e. directions and distances) compared to the rest of the audio signals received at the microphone array. For simplicity we will describe the case with only a single desired direction herein, but the same method will apply when there are more directions of interest. The angle (and/or the distance) from which the desired audio signal is received at the microphone array, so-called Direction of Arrival ("DOA") information, can be determined or set prior to the beamforming process. It can be advantageous to set the desired direction of arrival to be fixed since the estimation of the direction of arrival may be complex. However, in alternative situations it can be advantageous to adapt the desired direction of arrival to changing conditions, and so it may be advantageous to perform the estimation of the desired direction of arrival in real-time as the beamformer is used. Adaptive beamformers apply a number of "beamformer coefficients" to the received audio signals. These beamformer coefficients can be adapted to take into account the DOA information to process the audio signals received by the plurality of microphones to form a "beam" whereby a high gain is applied to the desired audio signals received by the microphones from a desired location (i.e. a desired direction and distance) and a low gain is applied in the directions to any other (e.g. interfering or undesired) signal sources. The beamformer may be "adaptive" in the sense that the suppression of interfering sources can be adapted, but the selection of the desired source/look direction may not necessarily be adaptable.

As described above, an aim of microphone beamforming is to combine the microphone signals of a microphone array in such a way that undesired signals are suppressed in relation to desired signals. In adaptive beamforming, the manner in which the microphone signals are combined in the beamformer is based on the signals that are received at the microphone array, and thereby the interference suppressing power of the beamformer can be focused to suppress the actual undesired sources that are in the input signals.

As well as having a plurality of microphones for receiving audio signals, a device may also have audio output means (e.g. comprising a loudspeaker) for outputting audio signals. Such a device is useful, for example where audio signals are to be outputted to, and received from, a user of the device, for example during a communication event. For example, the device may be a user device such as a telephone, computer or television and may include equipment necessary to allow the user to engage in teleconferencing.

Where a device includes both audio output means (e.g. including a loudspeaker) and audio input means (e.g. microphones) then there is often a problem when an echo is present in the received audio signals, wherein the echo results from audio signals being output from the loudspeaker and received at the microphones. The audio signals being output from the loudspeaker include echo and also other sounds played by the loudspeaker, such as music or audio, e.g., from a video clip. The device may include an Acoustic Echo Canceller (AEC) which operates to cancel the echo in the audio signals received by the microphones.

Although the AEC is used to cancel loudspeaker echoes from the signals received at the microphones, a beamformer (as described above) may simplify the task for the echo canceller by suppressing the level of the echo in the echo canceller input. The benefit of that would be increased echo canceller transparency. For example, when echo is present in audio signals received at a device which implements a beamformer as described above, the echo can be treated as interference in the received audio signals and the beamformer coefficients can be adapted such that the beamformer applies a low gain to the audio signals arriving from the direction (and/or distance) of the echo signals.

SUMMARY

In adaptive beamformers it may be a highly desired property to have a slowly evolving beampattern. Fast changes to the beampattern tend to cause audible changes in the background noise characteristics, and as such are not perceived as natural. Therefore when adapting the beamformer coefficients in response to the far end activity in a communication event as described above, there is a trade-off to be made between quickly suppressing the echo, and not changing the beampattern too quickly.

The inventor has realized that in a device including a beamformer and an echo canceller there is conflict of interests in the operation of the beamformer. In particular, from one perspective it is desirable for the adaptation of the beamformer coefficients to be performed in a slow manner to thereby provide a smooth beamformer behavior which is not perceived as disturbing to the user. However, from another perspective, a slow adaptation of the beamformer coefficients may introduce a delay between the time at which the beamformer begins receiving an echo signal and the time at which the beamformer coefficients are suitably adapted to suppress the echo signal. Such a delay may be detrimental because it is desirable to suppress loudspeaker echoes as rapidly as possible. It may therefore be useful to control the manner in which the beamformer coefficients are adapted.

According to a first aspect of the invention there is provided a method of processing signals at a device, the method comprising: receiving signals at a plurality of sensors of the device; determining the initiation of a signal state in which signals of a particular type are received at the plurality of sensors; responsive to said determining the initiation of said signal state, retrieving, from a data store, data indicating beamformer coefficients to be applied by a beamformer of the device, said indicated beamformer coefficients being determined so as to be suitable for application to signals received at the sensors in said signal state; and the beamformer applying the indicated beamformer coefficients to the signals received at the sensors in said signal state, thereby generating a beamformer output.

The retrieval of the data indicating the beamformer coefficients from the data store allows the beamformer to be adapted quickly to the signal state. In this way, in preferred embodiments, loudspeaker echoes can be suppressed rapidly. For example, when the signals are audio signals and the signal state is an echo state in which echo audio signals output from audio output means of the device are received at the sensors (e.g. microphones) then the beamforming performance of an adaptive beamformer can be improved in that the optimal beamformer behavior can be rapidly achieved, for example in a teleconferencing setup where loudspeaker echo is frequently occurring. As a result, in these examples the transparency of the echo canceller may be increased, as the loudspeaker echo in the microphone signal is more rapidly decreased.

Prior to the initiation of said signal state the device may operate in an other signal state in which the beamformer applies other beamformer coefficients which are suitable for application to signals received at the sensors in said other signal state, and the method may further comprise storing said other beamformer coefficients in said data store responsive to said determining the initiation of said signal state.

The method may further comprise: determining the initiation of said other signal state; responsive to determining the initiation of said other signal state, retrieving, from the data store, data indicating said other beamformer coefficients; and the beamformer applying said indicated other beamformer coefficients to the signals received at the sensors in said other signal state, thereby generating a beamformer output. The method may further comprise, responsive to said determining the initiation of said other signal state, storing, in said data store, data indicating the beamformer coefficients applied by the beamformer prior to the initiation of said other signal state.

In preferred embodiments the sensors are microphones for receiving audio signals and the device comprises audio output means for outputting audio signals in a communication event, and said signals of a particular type are echo audio signals output from the audio output means and the signal state is an echo state. The other signal state may be a non-echo state in which echo audio signals are not significantly received at the microphones.

The step of determining the initiation of the signal state may be performed before the signal state is initiated. The step of determining the initiation of the echo state may comprise determining output activity of the audio output means in the communication event. The method may further comprise, responsive to retrieving said beamformer coefficients, adapting the beamformer to thereby apply the retrieved beamformer coefficients to the signals received at the sensors before the initiation of the signal state.

The step of determining the initiation of the signal state may comprise determining that signals of the particular type are received at the sensors.

The step of the beamformer applying the indicated beamformer coefficients may comprise smoothly adapting the beamformer coefficients applied by the beamformer until they match the indicated beamformer coefficients.

The step of the beamformer applying the indicated beamformer coefficients may comprise performing a weighted sum of: (i) an old beamformer output determined using old beamformer coefficients which were applied by the beamformer prior to said determining the initiation of the signal state, and (ii) a new beamformer output determined using the indicated beamformer coefficients. The method may further comprise smoothly adjusting the weight used in the weighted sum, such that the weighted sum smoothly transitions between the old beamformer output and the new beamformer output.

The method may further comprise adapting the beamformer coefficients based on the signals received at the sensors such that the beamformer applies suppression to undesired signals received at the sensors.

The data indicating the beamformer coefficients may be the beamformer coefficients.

The data indicating the beamformer coefficients may comprise a measure of the signals received at the sensors, wherein the measure is related to the beamformer coefficients using a predetermined function. The method may further comprise computing the beamformer coefficients using the retrieved measure and the predetermined function. The method may further comprise smoothly adapting the measure to thereby smoothly adapt the beamformer coefficients applied by the beamformer.

The method may further comprise using the beamformer output to represent the signals received at the plurality of sensors for further processing within the device.

The beamformer output may be used by the device in a communication event. The method may further comprise applying an echo canceller to the beamformer output.

The signals may be one of: (i) audio signals, (ii) general broadband signals, (iii) general narrowband signals, (iv) radar signals, (v) sonar signals, (vi) antenna signals, (vii) radio waves and (viii) microwaves.

According to a second aspect of the invention there is provided a device for processing signals, the device comprising: a beamformer; a plurality of sensors for receiving signals; means for determining the initiation of a signal state in which signals of a particular type are received at the plurality of sensors; and means for retrieving from a data store, responsive to the means for determining the initiation of said signal state, data indicating beamformer coefficients to be applied by the beamformer, said indicated beamformer coefficients being determined so as to be suitable for application to signals received at the sensors in said signal state, wherein the beamformer is configured to apply the indicated beamformer coefficients to signals received at the sensors in said signal state, to thereby generate a beamformer output.

The device may further comprise the data store. In preferred embodiments the sensors are microphones for receiving audio signals and the device further comprises audio output means for outputting audio signals in a communication event, and said signals of a particular type are echo audio signals output from the audio output means and the signal state is an echo state.

The device may further comprise an echo canceller configured to be applied to the beamformer output.

According to a third aspect of the invention there is provided a computer program product for processing signals at a device, the computer program product being embodied on a non-transient computer-readable medium and configured so as when executed on a processor of the device to perform any of the methods described herein.

BRIEF DESCRIPTION OF THE DRAWINGS

For a better understanding of the present invention and to show how the same may be put into effect, reference will now be made, by way of example, to the following drawings in which.

DETAILED DESCRIPTION

Preferred embodiments of the invention will now be described by way of example only. In preferred embodiments a determination is made that a signal state either is about to be initiated or has recently been initiated, wherein in the signal state a device receives signals of a particular type. Data indicating beamformer coefficients which are adapted to be suited for use with signals of the particular type (of the signal state) is retrieved from a memory and a beamformer of the device is adapted to thereby apply the indicated beamformer coefficients to signals received in the signal state. By retrieving the data indicating the beamformer coefficients the behavior of the beamformer can quickly be adapted to suit the signals of the particular type which are received at the device in the signal state. For example, the signals of the particular type may be echo signals, wherein the beamformer coefficients can be retrieved to thereby quickly suppress the echo signals in a communication event.

Figure 1:
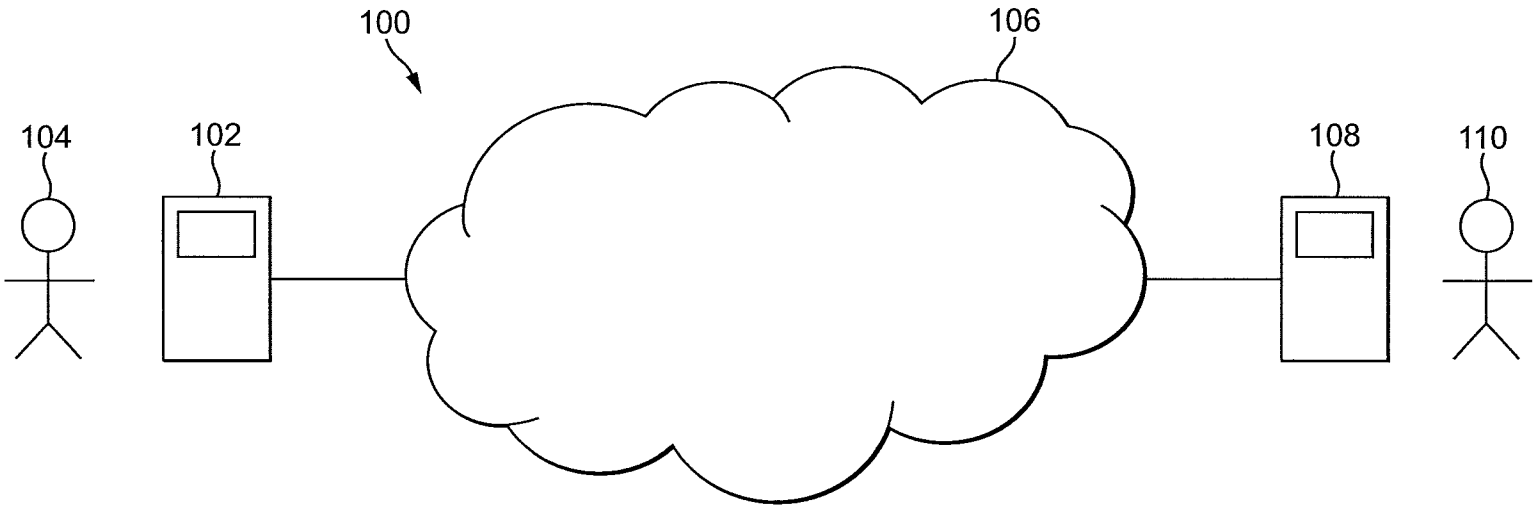
FIG. 1 shows a communication system according to a preferred embodiment.

Reference is first made to FIG. 1 which illustrates a communication system 100 according to a preferred embodiment. The communication system 100 comprises a first device 102 which is associated with a first user 104. The first device 102 is connected to a network 106 of the communication system 100. The communication system 100 also comprises a second device 108 which is associated with a second user 110. The device 108 is also connected to the network 106. Only two devices (102 and 108) are shown in FIG. 1 for clarity, but it will be appreciated that more than two devices may be connected to the network 106 of the communication system 100 in a similar manner to that shown in FIG. 1 for devices 102 and 108. The devices of the communication system 100 (e.g. devices 102 and 108) can communicate with each other over the network 106 in the communication system 100, thereby allowing the users 104 and 110 to engage in communication events to thereby communicate with each other. The network 106 may, for example, be the Internet. Each of the devices 102 and 108 may be, for example, a mobile phone, a personal digital assistant ("PDA"), a personal computer ("PC") (including, for example, Windows™, Mac OS™ and Linux™ PCs), a laptop, a television, a gaming device or other embedded device able to connect to the network 106. The devices 102 and 108 are arranged to receive information from and output information to the respective users 104 and 110.

Figure 2:
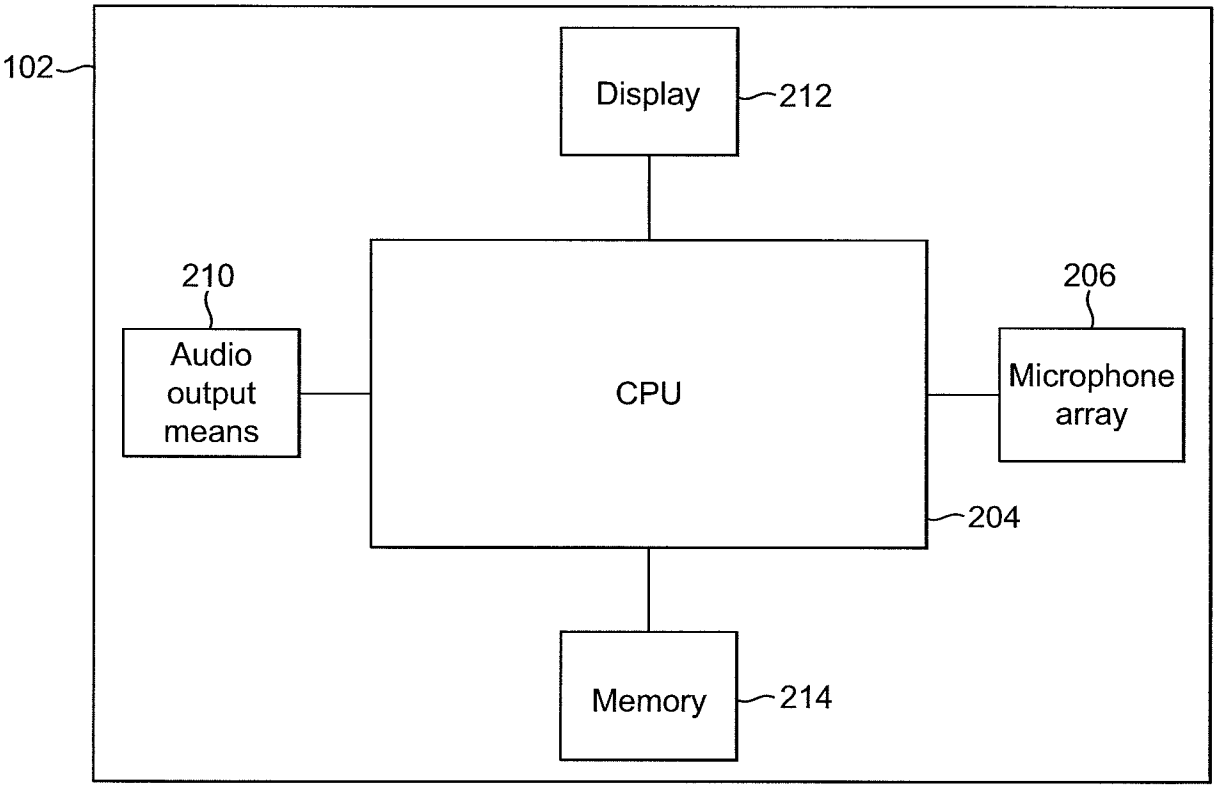
FIG. 2 shows a schematic view of a device according to a preferred embodiment.

Reference is now made to FIG. 2 which illustrates a schematic view of the device 102. The device 102 may be a fixed or a mobile device. The device 102 comprises a CPU 204, to which is connected a microphone array 206 for receiving audio signals, audio output means 210 for outputting audio signals, a display 212 such as a screen for outputting visual data to the user 104 of the device 102 and a memory 214 for storing data.

Figure 3:
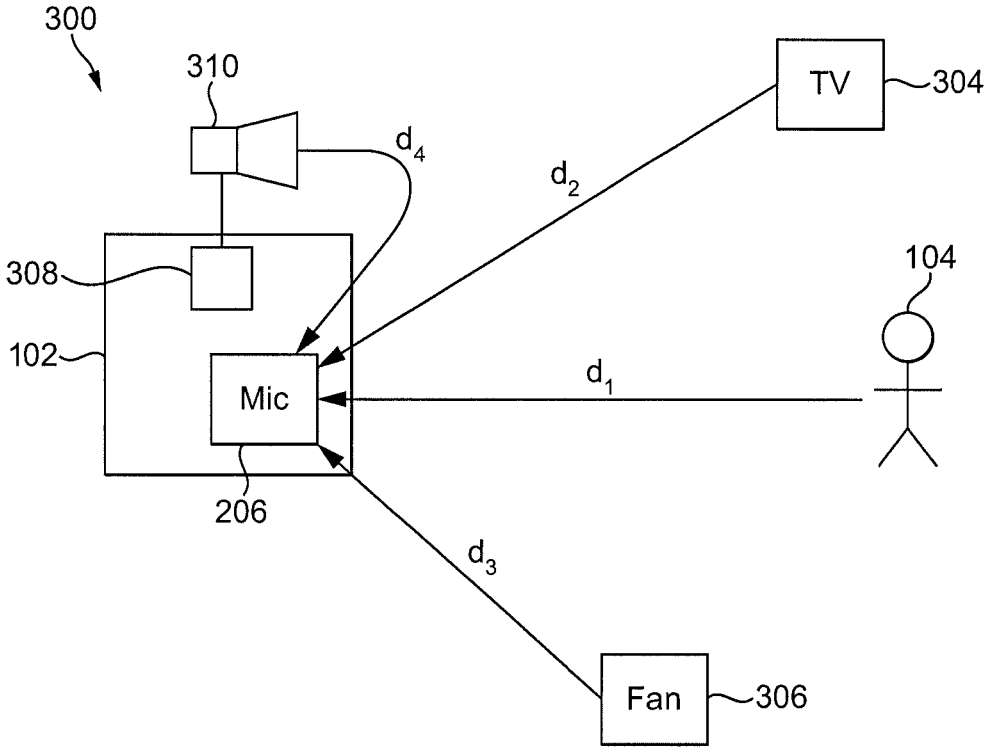
FIG. 3 shows an environment in which a device according to a preferred embodiment operates.

Reference is now made to FIG. 3, which illustrates an example environment 300 in which the device 102 operates.

The microphone array 206 of the device 102 receives audio signals from the environment 300. For example, as shown in FIG. 3, the microphone array 206 receives audio signals from a user 104 (as denoted $d_1$ in FIG. 3), audio signals from a TV 304 (as denoted $d_2$ in FIG. 3), audio signals from a fan 306 (as denoted $d_3$ in FIG. 3) and audio signals from a loudspeaker 310 (as denoted $d_4$ in FIG. 3). The audio output means 210 of the device 102 comprise audio output processing means 308 and the loudspeaker 310. The audio output processing means 308 operates to send audio output signals to the loudspeaker 310 for output from the loudspeaker 310. The loudspeaker 310 may be implemented within the housing of the device 102. Alternatively, the loudspeaker 310 may be implemented outside of the housing of the device 102. The audio output processing means 308 may operate as software executed on the CPU 204, or as hardware in the device 102. It will be apparent to a person skilled in the art that the microphone array 206 may receive other audio signals than those shown in FIG. 3. In the scenario shown in FIG. 3 the audio signals from the user 104 are the desired audio signals, and all the other audio signals which are received at the microphone array 206 are interfering audio signals. In other embodiments more than one of the audio signals received at the microphone array 206 may be considered "desired" audio signals, but for simplicity, in the embodiments described herein there is only one desired audio signal (that being the audio signal from user 104) and the other audio signals are considered to be interference. Other sources of unwanted noise signals may include for example air-conditioning systems, a device playing music, other users in the environment and reverberance of audio signals, e.g. off a wall in the environment 300.

Figure 4:
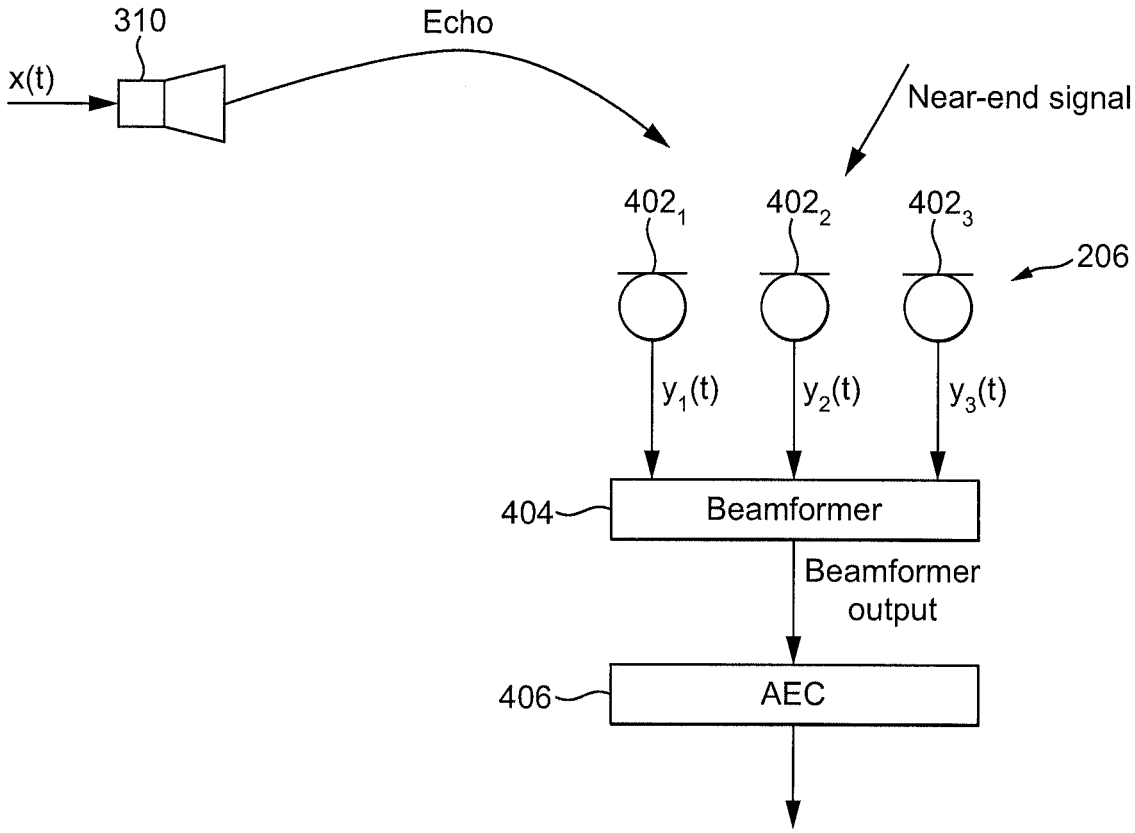
FIG. 4 shows a functional block diagram of elements of a device according to a preferred embodiment.

Reference is now made to FIG. 4 which illustrates a functional representation of elements of the device 102 according to a preferred embodiment of the invention. The microphone array 206 comprises a plurality of microphones $\mathbf{402}_1$, $\mathbf{402}_2$ and $\mathbf{402}_3$. The device 102 further comprises a beamformer 404 which may, for example, be a Minimum Variance Distortionless Response (MVDR) beamformer. The device 102 further comprises an acoustic echo canceller (AEC) 406. The beamformer 404 and the AEC 406 may be implemented in software executed on the CPU 204 or implemented in hardware in the device 102. The output of each microphone 402 in the microphone array 206 is coupled to a respective input of the beamformer 404. Persons skilled in the art will appreciate that multiple inputs are needed in order to implement beamforming. The output of the beamformer 404 is coupled to an input of the AEC 406. The microphone array 206 is shown in FIG. 4 as having three microphones ($\mathbf{402}_1$, $\mathbf{402}_2$ and $\mathbf{402}_3$), but it will be understood that this number of microphones is merely an example and is not limiting in any way.

The beamformer 404 includes means for receiving and processing the audio signals $y_1(t)$, $y_2(t)$ and $y_3(t)$ from the microphones $\mathbf{402}_1$, $\mathbf{402}_2$ and $\mathbf{402}_3$ of the microphone array 206. For example, the beamformer 404 may comprise a voice activity detector (VAD) and a DOA estimation block (not shown in the Figures). In operation the beamformer 404 ascertains the nature of the audio signals received by the microphone array 206 and based on detection of speech like qualities detected by the VAD and the DOA estimation block, one or more principal direction(s) of the main speaker(s) is determined. In other embodiments the principal direction(s) of the main speaker(s) may be pre-set such that the beamformer 404 focuses on fixed directions. In the example shown in FIG. 3 the direction of audio signals ($d_1$) received from the user 104 is determined to be the principal direction. The beamformer 404 may use the DOA information (or may simply use the fixed look direction which is pre-set for use by the beamformer 404) to process the audio signals by forming a beam that has a high gain in the direction from the principal direction ($d_1$) from which wanted signals are received at the microphone array 206 and a low gain in the directions to any other signals (e.g. d2, d3 and d4).

The beamformer 404 can also determine the interfering directions of arrival (d2, d3 and d4), and advantageously the behavior of the beamformer 404 can be adapted such that particularly low gains are applied to audio signals received from those interfering directions of arrival in order to suppress the interfering audio signals. Whilst it has been described above that the beamformer 404 can determine any number of principal directions, the number of principal directions determined affects the properties of the beamformer 404, e.g. for a large number of principal directions the beamformer 404 may apply less attenuation of the signals received at the microphone array 206 from the other (unwanted) directions than if only a single principal direction is determined. Alternatively the beamformer 404 may apply the same suppression to a certain undesired signal even when there are multiple principal directions: this is dependent upon the specific implementation of the beamformer 404. The optimal beamforming behavior of the beamformer 404 is different for different scenarios where the number of, powers of, and locations of undesired sources differ. When the beamformer 404 has limited degrees of freedom, a choice is made between either (i) suppressing one signal more than other signals, or (ii) suppressing all the signals by the same amount. There are many variants of this, and the actual suppression chosen to be applied to the signals depends on the scenario currently experienced by the beamformer 404. The output of the beamformer 404 may be provided in the form of a single channel to be processed. It is also possible to output more than one channel, for example to preserve or to virtually generate a stereo image. The output of the beamformer 404 is passed to the AEC 406 which cancels echo in the beamformer output. Techniques to cancel echo in the signals using the AEC 406 are known in the art and the details of such techniques are not described in detail herein. The output of the AEC 406 may be used in many different ways in the device 102 as will be apparent to a person skilled in the art. For example, the output of the beamformer 404 could be used as part of a communication event in which the user 104 is participating using the device 102.

The other device 108 in the communication system 100 may have corresponding elements to those described above in relation to device 102.

When the adaptive beamformer 404 is performing well, it estimates its behavior (i.e. the beamformer coefficients) based on the signals received at the microphones 402 in a slow manner in order to have a smooth beamforming behavior that does not rapidly adjust to sudden onsets of undesired sources. There are two primary reasons for adapting the beamformer coefficients of the beamformer 404 in a slow manner. Firstly, it is not desired to have a rapidly changing beamformer behavior since that may be perceived as very disturbing by the user 104. Secondly, from a beamforming perspective it makes sense to suppress the undesired sources that are prominent most of the time: that is, undesired signals which last for only a short duration are typically less important to suppress than constantly present undesired signals. However, as described above, it is desirable that loudspeaker echoes are suppressed as rapidly as possible.

In methods described herein the beamformer state (e.g. the beamformer coefficients which determine the beamforming effects implemented by the beamformer 404 in combining the microphone signals $y_1(t)$, $y_2(t)$ and $y_3(t)$) is stored in the memory 214, for the two scenarios (i) when there is no echo, and (ii) when there is echo. As soon as loudspeaker activity is detected, for example as soon as a signal is received in a communication event for output from the loudspeaker 310 then the beamformer 404 can be set to the pre-stored beamformer state for beamforming during echo activity. Loudspeaker activity can be detected by the teleconferencing setup (which includes the beamformer 404), used in the device 102 for engaging in communication events over the communication system 100. At the same time the beamformer state (that is, the beamformer coefficients used by the beamformer 404 before the echo state is detected) is saved in the memory 214 as the beamforming state for non-echo activity. When the echo stops being present the beamformer 404 is set to the pre-stored beamformer state for beamforming during non-echo activity (using the beamformer coefficients previously stored in the memory 214) and at the same time the beamformer state (i.e. the beamformer coefficients used by the beamformer 404 before the echo state is finished) is saved as the beamforming state for echo activity. The transitions between the beamformer states, i.e. the adaptation of the beamformer coefficients applied by the beamformer 404, are made smoothly over a finite period of time (rather than being instantaneous transitions), to thereby reduce the disturbance perceived by the user 104 caused by the transitions.

Figure 5:
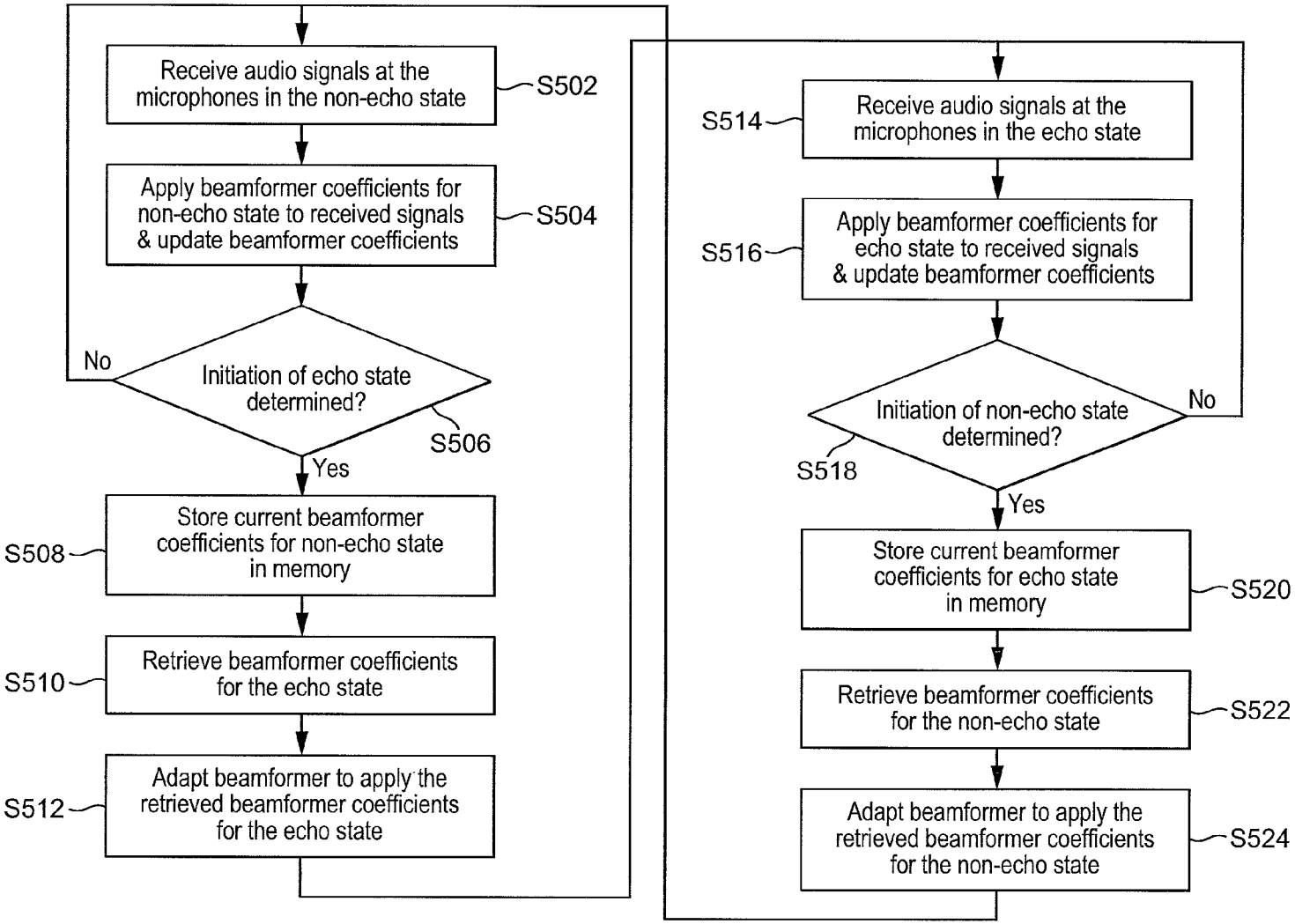
FIG. 5 is a flow chart for a process of processing signals according to a preferred embodiment.

With reference to FIG. 5 there is now described a method of processing data according to a preferred embodiment. The user 104 engages in a communication event (such as an audio or video call) with the user 110, wherein data is transmitted between the devices 102 and 108 in the communication event. When audio data is not received at the device 102 from the device 108 in the communication event then the device 102 operates in a non-echo state in which echo signals are not output from the loudspeaker 310 and received at the microphone array 206.

In step S502 audio signals are received at the microphones $\mathbf{402}_1$, $\mathbf{402}_2$ and $\mathbf{402}_3$ of the microphone array 206 in the non-echo state. The audio signals may, for example, be received from the user 104, the TV 304 and/or the fan 306.

In step S504 the audio signals received at the microphones $\mathbf{402}_1$, $\mathbf{402}_2$ and $\mathbf{402}_3$ are passed to the beamformer 404 (as signals $y_1(t)$, $y_2(t)$ and $y_3(t)$ as shown in FIG. 4) and the beamformer 404 applies beamformer coefficients for the non-echo state to the audio signals $y_1(t)$, $y_2(t)$ and $y_3(t)$ to thereby generate the beamformer output. As described above the beamforming process combines the received audio signals $y_1(t)$, $y_2(t)$ and $y_3(t)$ in such a way (in accordance with the beamformer coefficients) that audio signals received from one location (i.e. direction and distance) may be enhanced relative to audio signals received from another location. For example, in the non-echo state the microphones $\mathbf{402}_1$, $\mathbf{402}_2$ and $\mathbf{402}_3$ may be receiving desired audio signals from the user 104 (from direction $d_1$) for use in the communication event and may also be receiving interfering, undesired audio signals from the fan 306 (from direction $d_3$). The beamformer coefficients applied by the beamformer 404 can be adapted such that the audio signals received from direction $d_1$ (from the user 104) are enhanced relative to the audio signals received from direction $d_3$ (from the fan 306). This may be done by applying suppression to the audio signals received from direction $d_3$ (from the fan 306).

The beamformer output may be passed to the AEC 406 as shown in FIG. 4. However, in the non-echo state the AEC 406 might not perform any echo cancellation on the beamformer output. Alternatively, in the non-echo state the beamformer output may bypass the AEC 406.

In step S506 it is determined whether an echo state either has been initiated or is soon to be initiated. For example, it may be determined that an echo state has been initiated if audio signals of the communication event (e.g. audio signals received from the device 108 in the communication event) which have been output from the loudspeaker 310 are received by the microphones $\mathbf{402}_1$, $\mathbf{402}_2$ and $\mathbf{402}_3$ of the microphone array 206. Alternatively, audio signals may be received at the device 102 from the device 108 over the network 106 in the communication event to be output from the loudspeaker 310 at the device 102. An application (executed on the CPU 204) handling the communication event at the device 102 may detect the loudspeaker activity that is about to occur when the audio data is received from the device 108 and may indicate to the beamformer 404 that audio signals of the communication event are about to be output from the loudspeaker 310. In this way the initiation of the echo state can be determined before the echo state is actually initiated, i.e. before the loudspeaker 310 outputs audio signals received from the device 108 in the communication event. For example, there may be a buffer in the playout soundcard where the audio samples are placed before being output from the loudspeaker 310. The buffer would need to be traversed before the audio signals can be played out, and the delay in this buffer will allow us to detect the loudspeaker activity before the corresponding audio signals are played in the loudspeaker 310.

If the initiation of the echo state is not determined in step S506 then the method passes back to step S502. Steps S502, S504 and S506 repeat in the non-echo state, such that audio signals are received and the beamformer applies beamformer coefficients for the non-echo state to the received audio signals until the initiation of the echo state is determined in step S506. The beamformer 404 also updates the beamformer coefficients in real-time according to the received signals in an adaptive manner. In this way the beamformer coefficients are adapted to suit the received signals.

If the initiation of the echo state is determined in step S506 then the method passes to step S508. In step S508 the current beamformer coefficients which are being applied by the beamformer 404 in the non-echo state are stored in the memory 214. This allows the beamformer coefficients to be subsequently retrieved when the non-echo state is subsequently initiated again (see step S522 below).

In step S510 beamformer coefficients for the echo state are retrieved from the memory 214. The retrieved beamformer coefficients are suited for use in the echo state. For example, the retrieved beamformer coefficients may be the beamformer coefficients that were applied by the beamformer 404 during the previous echo state (which may be stored in the memory 214 as described below in relation to step S520).

In step S512 the beamformer 404 is adapted so that it applies the retrieved beamformer coefficients for the echo state to the signals $y_1(t)$, $y_2(t)$ and $y_3(t)$. The beamformer coefficients applied by the beamformer 404 can be changed smoothly over a period of time (e.g. in the range 0.5 to 1 second) to thereby avoid sudden changes to the beampattern of the beamformer 404. As an alternative to changing the beamformer coefficients, there are two sets of beamformer coefficients which do not change, the two sets being: (i) old beamformer coefficients (i.e. those used in the non-echo state just prior to the determination of the initiation of the echo state), and (ii) new beamformer coefficients (i.e. those retrieved from the memory 214 for the echo state) and a respective beamformer output is computed using both the new and the old beamformer coefficients. The beamformer 404 transitions smoothly between using the old beamformer output (i.e. the beamformer output computed using the old beamformer coefficients) and the new beamformer output (i.e. the beamformer output computed using the new beamformer coefficients).

The smooth transition can be made by applying respective weights to the old and new beamformer outputs to form a combined beamformer output which is used for the output of the beamformer 404. The weights are slowly adjusted to make a gradual transition from the beamformer output using the old beamformer coefficients, to the output using the new beamformer coefficients.

This can be expressed using the following equations:

$$y_{old}(t) = \sum_{m=1}^{M} \sum_{k=0}^{K-1} w_{m\cdot k}^{old} x_m(t-k)$$

$$y_{new}(t) = \sum_{m=1}^{M} \sum_{k=0}^{K-1} w_{m\cdot k}^{new} x_m(t-k)$$

$$y(t) = g(t) y_{old}(t) + (1 - g(t)) y_{new}(t)$$

Where $w_{m.k}^{old}$ and $w_{m.k}^{new}$ are the old and new beamformer coefficients respectively with coefficient index k applied to microphone signal m ($x_m(t-k)$) and g(t) is a weight that is slowly over time adjusted from 1 to 0. $y_{old}(t)$ and $y_{new}(t)$ are the beamformer outputs using the old and new beamformer coefficients. y(t) is the final beamformer output of the beamformer 404. It can be seen here that an alternative to adjusting the beamformer coefficients themselves is to implement a gradual transition from the output achieved using the old beamformer coefficients to the output achieved using the new beamformer coefficients. This has the same advantages as gradually changing the beamformer coefficients in that the beamformer output from the beamformer 404 does not have sudden changes and may therefore not be disturbing to the user 104. For simplicity, the equations given above describe the example in which the beamformer 404 has a mono beamformer output, but the equations can be generalized to cover beamformers with stereo outputs.

As described above a time-dependent weighting (g(t)) may be used to weight the old and new beamformer coefficients so that the weight of the old output is gradually reduced from 1 to 0, and the weight of the new output gradually is increased from 0 to 1, until the weight of the new output is 1, and the weight of the old output is 0.

Sudden changes to the beampattern of the beamformer 404 can be disturbing to the user 104 (or the user 110).

The beamformer coefficients applied by the beamformer 404 in the echo state are determined such that the beamformer 404 applies suppression to the signals received from the loudspeaker 310 (from direction $d_4$) at the microphones $\mathbf{402}_1$, $\mathbf{402}_2$ and $\mathbf{402}_3$ of the microphone array 206. In this way the beamformer 404 can suppress the echo signals in the communication event. The beamformer 404 can also suppress other disturbing signals received at the microphone array 206 in the communication event in a similar manner.

Since the beamformer 404 is an adaptive beamformer 404, it will continue to monitor the signals received during the echo state and if necessary adapt the beamformer coefficients used in the echo state such that they are optimally suited to the signals being received at the microphones $\mathbf{402}_1$, $\mathbf{402}_2$ and $\mathbf{402}_3$ of the microphone array 206.

The method continues to step S514 with the device 102 operating in the echo state. In step S514 audio signals are received at the microphones $\mathbf{402}_1$, $\mathbf{402}_2$ and $\mathbf{402}_3$ of the microphone array 206 in the echo state. The audio signals may, for example, be received from the user 104, the loudspeaker 310, the TV 304 and/or the fan 306.

In step S516 the audio signals received at the microphones $\mathbf{402}_1$, $\mathbf{402}_2$ and $\mathbf{402}_3$ are passed to the beamformer 404 (as signals $y_1(t)$, $y_2(t)$ and $y_3(t)$ as shown in FIG. 4) and the beamformer 404 applies beamformer coefficients for the echo state to the audio signals $y_1(t)$, $y_2(t)$ and $y_3(t)$ to thereby generate the beamformer output. As described above the beamforming process combines the received audio signals $y_1(t)$, $y_2(t)$ and $y_3(t)$ in such a way (in accordance with the beamformer coefficients) that audio signals received from one location (i.e. direction and distance) may be enhanced relative to audio signals received from another location. For example, in the echo state the microphones $\mathbf{402}_1$, $\mathbf{402}_2$ and $\mathbf{402}_3$ may be receiving desired audio signals from the user 104 (from direction $d_1$) for use in the communication event and may also be receiving interfering, undesired echo audio signals from the loudspeaker 310 (from direction $d_4$). The beamformer coefficients applied by the beamformer 404 can be adapted such that the audio signals received from direction $d_1$ (from the user 104) are enhanced relative to the echo audio signals received from direction $d_4$ (from the loudspeaker 310). This may be done by applying suppression to the echo audio signals received from direction $d_4$ (from the loudspeaker 310).

The beamformer output may be passed to the AEC 406 as shown in FIG. 4. In the echo state the AEC 406 performs echo cancellation on the beamformer output. The use of the beamformer 404 to suppress some of the echo prior to the use of the AEC 406 allows a more efficient echo cancellation to be performed by the AEC 406, whereby the echo cancellation performed by the AEC 406 is more transparent. The echo canceller 406 (which includes an echo suppressor) needs to apply less echo suppression when the echo level in the received audio signals is low compared to when the echo level in the received audio signals is high in relation to a near-end (desired) signal. This is because the amount of echo suppression applied by the AEC 406 is set according to how much the near-end signal is masking the echo signal. The masking effect is larger for lower echo levels and if the echo is fully masked, no echo suppression is needed to be applied by the AEC 406.

In step S518 it is determined whether a non-echo state has been initiated. For example, it may be determined that a non-echo state has been initiated if audio signals of the communication event have not been received from the device 108 for some predetermined period of time (e.g. in the range 1 to 2 seconds), or if audio signals of the communication event have not been output from the loudspeaker 310 and received by the microphones $\mathbf{402}_1$, $\mathbf{402}_2$ and $\mathbf{402}_3$ of the microphone array 206 for some predetermined period of time (e.g. in the range 1 to 2 seconds).

If the initiation of the non-echo state is not determined in step S518 then the method passes back to step S514. Steps S514, S516 and S518 repeat in the echo state, such that audio signals are received and the beamformer 404 applies beamformer coefficients for the echo state to the received audio signals (to thereby suppress the echo in the received signals) until the initiation of the non-echo state is determined in step S518. The beamformer 404 also updates the beamformer coefficients in real-time according to the received signals in an adaptive manner. In this way the beamformer coefficients are adapted to suit the received signals.

If the initiation of the non-echo state is determined in step S518 then the method passes to step S520. In step S520 the current beamformer coefficients which are being applied by the beamformer 404 in the echo state are stored in the memory 214. This allows the beamformer coefficients to be subsequently retrieved when the echo state is subsequently initiated again (see step S510).

In step S522 beamformer coefficients for the non-echo state are retrieved from the memory 214. The retrieved beamformer coefficients are suited for use in the non-echo state. For example, the retrieved beamformer coefficients may be the beamformer coefficients that were applied by the beamformer 404 during the previous non-echo state (which were stored in the memory 214 in step S508 as described above).

In step S524 the beamformer 404 is adapted so that it applies the retrieved beamformer coefficients for the non-echo state to the signals $y_1(t)$, $y_2(t)$ and $y_3(t)$. The beamformer coefficients applied by the beamformer 404 can be changed smoothly over a period of time (e.g. in the range 0.5 to 1 second) to thereby avoid sudden changes to the beampattern of the beamformer 404. Sudden changes to the beampattern of the beamformer 404 can be disturbing to the user 104 (or the user 110). As an alternative to changing the beamformer coefficients, as described above, the beamformer output can be smoothly transitioned between an old beamformer output (for the echo state) and a new beamformer output (for the non-echo state) by smoothly adjusting a weighting used in a weighted sum of the old and new beamformer outputs.

The beamformer coefficients applied by the beamformer 404 in the non-echo state are determined such that the beamformer 404 applies suppression to the interfering signals received at the microphones $\mathbf{402}_1$, $\mathbf{402}_2$ and $\mathbf{402}_3$ of the microphone array 206, such as from the TV 304 or the fan 306.

Alternatively, instead of retrieving the beamformer coefficients for the non-echo state, the method may bypass steps S522 and S524. In this way the beamformer coefficients are not retrieved from memory 214 for the non-echo state and instead the beamformer coefficients will simply adapt to the received signals $y_1(t)$, $y_2$ (t) and $y_3(t)$. It is important to quickly adapt to the presence of echo when the echo state is initiated as described above, which is why the retrieval of beamformer coefficients for the echo state is particularly advantageous. Although it is still beneficial, it is less important to quickly adapt to the non-echo state than to quickly adapt to the echo state, which is why some embodiments may bypass steps S522 and S524 as described in this paragraph.

Since the beamformer 404 is an adaptive beamformer 404, it will continue to monitor the signals received during the non-echo state and if necessary adapt the beamformer coefficients used in the non-echo state such that they are optimally suited to the signals being received at the microphones $\mathbf{402}_1$, $\mathbf{402}_2$ and $\mathbf{402}_3$ of the microphone array 206 (e.g. as the interfering signals from the TV 304 or the fan 306 change). The method then continues to step S502 with the device 102 operating in the non-echo state.

There is therefore described above in relation to FIG. 5 a method of operating the device 102 whereby the beamformer coefficients for different signal states (e.g. an echo state and a non-echo state) can be retrieved from the memory 214 and applied by the beamformer 404 when the respective signal states are initiated. This allows the beamformer 404 to be adapted quickly to suit the particular types of signals which are received at the microphone array 206 in the different signal states.

As an example, assuming that there is an undesired noise signal N(t) present all the time, and an undesired echo signal S(t) infrequently occurring, the beamformer state (i.e. the beamformer coefficients of the beamformer 404) for when there is echo would be adapted to suppressing the combination of N(t) and S(t) in the signals received at the microphones $\mathbf{402}_1$, $\mathbf{402}_2$ and $\mathbf{402}_3$ of the microphone array 206. In contrast, the beamformer state (i.e. the beamformer coefficients of the beamformer 404) for when there is no echo would be adapted to suppressing the noise signal N(t) only.

In a practical teleconferencing application the delay from when the application sees activity in the signals to be output from the loudspeaker 310 until the resulting echo arrives at the microphone array 206 may be quite long, e.g. it may be greater than 100 milliseconds. Embodiments of the invention advantageously allow the beamformer 404 to change its behavior (in a slow manner) by adapting its beamformer coefficients to be suited for suppressing the echo before the echo signals are actually received at the microphones $\mathbf{402}_1$, $\mathbf{402}_2$ and $\mathbf{402}_3$ of the microphone array 206. This allows the beamformer 404 to adapt to a good echo suppression beamformer state before the onset of the arrival of echo signals at the microphone array 206 in the echo state.

Figure 6A:
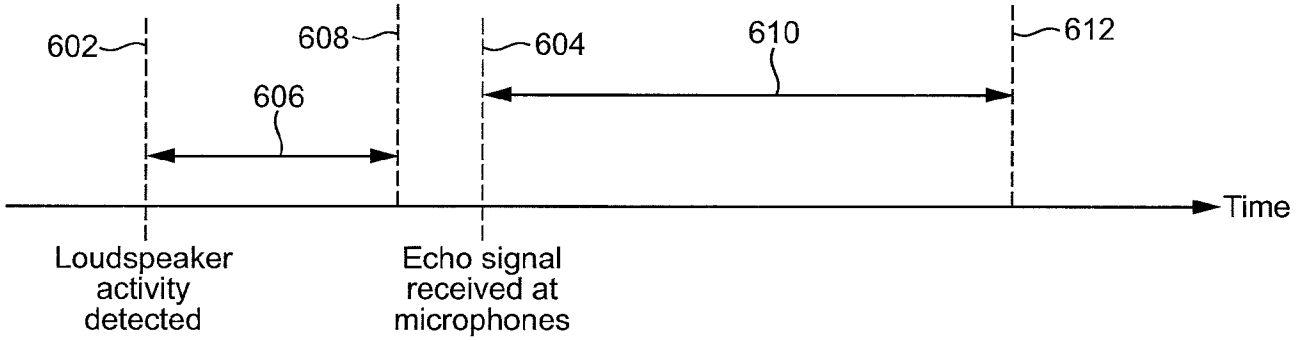
FIG. 6*a* is a timing diagram representing the operation of a beamformer in a first scenario.

FIG. 6*a* is a timing diagram representing the operation of the beamformer 404 in a first scenario. The device 102 is engaging in a communication event (e.g. an audio or video call) with the device 108 over the network 106. The beamformer 404 is initially operating in a non-echo mode before any audio signals of the communication event are output from the loudspeaker 310. At time 602 the application handling the communication event at the device 102 detects incoming audio data from the device 108 which is to be output from the loudspeaker 310 in the communication event. In other words, the application detects the initiation of the echo state. It is not until time 604 that the audio signals received from the device 108 in the communication event and output from the loudspeaker 310 begin to be received by the microphones $\mathbf{402}_1$, $\mathbf{402}_2$ and $\mathbf{402}_3$ of the microphone array 206. As described above, in response to detecting the initiation of the echo state at time 602, during the time 606 the beamformer coefficients for the echo state are retrieved from the memory 214 and the beamformer 404 is adapted so that it applies the retrieved beamformer coefficients by time 608. Therefore by time 608 the beamformer 404 is applying the beamformer coefficients (having a suitable beamforming effect) which are suitable for suppressing echo in the received signals $y_1(t)$, $y_2(t)$ and $y_3(t)$. Therefore the beamformer 404 is adapted for the echo state at time 608 which is prior to the onset of receipt of the echo signals at the microphones $\mathbf{402}_1$, $\mathbf{402}_2$ and $\mathbf{402}_3$ of the microphone array 206, which occurs at time 604.

This is in contrast to the prior art in which beamformer coefficients are adapted based on the received signals. This is shown by the duration 610 in FIG. 6*a*. In this case the beamformer state is not suited to the echo state until time 612. That is, during time 610 the beamformer is adapted based on the received audio signals (which include the echo) such that at time 612 the beamformer is suitably adapted to the echo state. It can be seen that the method of the prior art described here results in a longer period during which the beamformer coefficients are changed than that resulting from the method described above in relation to FIG. 5 (i.e. the time period 610 is longer than the time period 606). This is because in the method shown in FIG. 5 the beamformer coefficients are retrieved from the memory 214 so it is quick for the beamformer to adapt to those retrieved beamformer coefficients, whereas in the prior art the beamformer coefficients must be determined based on the received audio signals. Furthermore, in the prior art the beamformer does not begin adapting to the echo state until the echo signals are received at the microphones at time 604, whereas in the method described above in relation to FIG. 5 the beamformer 404 may begin adapting to the echo state when the loudspeaker activity is detected at time 602. Therefore, in the prior art the beamformer is not fully suited to the echo until time 612 which is later than the time 608 at which the beamformer 404 of preferred embodiments is suited to the echo.

Figure 6B:
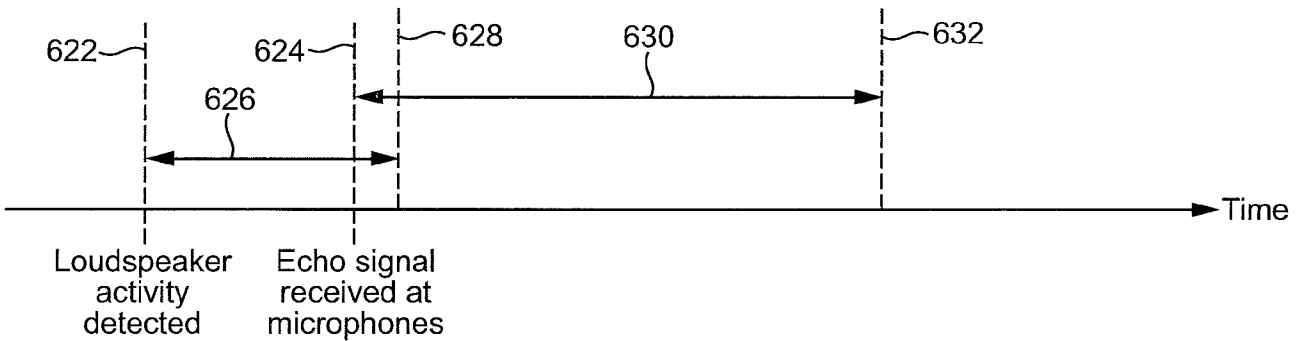
FIG. 6*b* is a timing diagram representing the operation of a beamformer in a second scenario.

FIG. 6*b* is a timing diagram representing the operation of the beamformer 404 in a second scenario. In the second scenario the echo is received at the microphones $\mathbf{402}_1$, $\mathbf{402}_2$ and $\mathbf{402}_3$ of the microphone array 206 before the beamformer coefficients have fully adapted to the echo state. The device 102 is engaging in a communication event (e.g. an audio or video call) with the device 108 over the network 106. The beamformer 404 is initially operating in a non-echo mode before any audio signals of the communication event are output from the loudspeaker 310. At time 622 the application handling the communication event at the device 102 detects incoming audio data from the device 108 which is to be output from the loudspeaker 310 in the communication event. In other words, the application detects the initiation of the echo state. It is not until time 624 that the audio signals received from the device 108 in the communication event and output from the loudspeaker 310 begin to be received by the microphones $\mathbf{402}_1$, $\mathbf{402}_2$ and $\mathbf{402}_3$ of the microphone array 206. As described above, in response to detecting the initiation of the echo state at time 622, during the time 626 the beamformer coefficients for the echo state are retrieved from the memory 214 and the beamformer 404 is adapted so that it applies the retrieved beamformer coefficients by time 628. Therefore by time 628 the beamformer 404 is applying the beamformer coefficients which are suitable for suppressing echo in the received signals $y_1(t)$, $y_2(t)$ and $y_3(t)$. Therefore the beamformer 404 is adapted for the echo state at time 628 which is very shortly after the onset of receipt of the echo signals at the microphones $\mathbf{402}_1$, $\mathbf{402}_2$ and $\mathbf{402}_3$ of the microphone array 206, which occurs at time 624.

This is in contrast to the prior art in which beamformer coefficients are adapted based on the received signals. This is shown by the duration 630 in FIG. 6*b*. In this case the beamformer state is not suited to the echo state until time 632. That is, during time 630 the beamformer is adapted based on the received audio signals (which include the echo) such that at time 632 the beamformer is suitably adapted to the echo state. It can be seen that the method of the prior art described here results in a longer period during which the beamformer coefficients are changed than that resulting from the method described above in relation to FIG. 5 (i.e. the time period 630 is longer than the time period 626). This is because in the method shown in FIG. 5 the beamformer coefficients are retrieved from the memory 214 so it is quick for the beamformer to adapt to those retrieved beamformer coefficients, whereas in the prior art the beamformer coefficients must be determined based on the received audio signals. Furthermore, in the prior art the beamformer does not begin adapting to the echo state until the echo signals are received at the microphones at time 624, whereas in the method described above in relation to FIG. 5 the beamformer 404 may begin adapting to the echo state when the loudspeaker activity is detected at time 622. Therefore, in the prior art the beamformer is not suited to the echo until time 632 which is later than the time 628 at which the beamformer 404 of preferred embodiments is suited to the echo.

The timing diagrams of FIGS. 6*a* and 6*b* are provided for illustrative purposes and are not necessarily drawn to scale.

As described above, the beamformer 404 may be implemented in software executed on the CPU 204 or implemented in hardware in the device 102. When the beamformer 404 is implemented in software, it may be provided by way of a computer program product embodied on a non-transient computer-readable medium which is configured so as when executed on the CPU 204 of the device 102 to perform the function of the beamformer 404 as described above. The method steps shown in FIG. 5 may be implemented as modules in hardware or software in the device 102.

Whilst the embodiments described above have referred to a microphone array 206 receiving one desired audio signal ($d_1$) from a single user 104, it will be understood that the microphone array 206 may receive audio signals from a plurality of users, for example in a conference call which may all be treated as desired audio signals. In this scenario multiple sources of wanted audio signals arrive at the microphone array 206.

The device 102 may be a television, laptop, mobile phone or any other suitable device for implementing the invention which has multiple microphones such that beamforming may be implemented. Furthermore, the beamformer 404 may be enabled for any suitable equipment using stereo microphone pickup.

In the embodiments described above, the loudspeaker 310 is a monophonic loudspeaker for outputting monophonic audio signals and the beamformer output from the beamformer 404 is a single signal. However, this is only in order to simplify the presentation and the invention is not limited to be used only for such systems. In other words, some embodiments of the invention may use stereophonic loudspeakers for outputting stereophonic audio signals, and some embodiments of the invention may use beamformers which output multiple signals.

In the embodiments described above the beamformer coefficients for the echo state and the beamformer coefficients for the non-echo state are stored in the memory 214 of the device 102. However, in alternative embodiments the beamformer coefficients for the echo state and the beamformer coefficients for the non-echo state may be stored in a data store which is not integrated into the device 102 but which may be accessed by the device 102, for example using a suitable interface such as a USB interface or over the network 106 (e.g. using a modem).

The non-echo state may be used when echo signals are not significantly received at the microphones $\mathbf{402}_1$, $\mathbf{402}_2$ and $\mathbf{402}_3$ of the microphone array 206. This may occur either when echo signals are not being output from the loudspeaker 310 in the communication event. Alternatively, this may occur when the device 102 is arranged such that signals output from the loudspeaker are not significantly received at the microphones $\mathbf{402}_1$, $\mathbf{402}_2$ and $\mathbf{402}_3$ of the microphone array 206. For example, when the device 102 operates in a hands free mode then the echo signals may be significantly received at the microphones $\mathbf{402}_1$, $\mathbf{402}_2$ and $\mathbf{402}_3$ of the microphone array 206. However, when the device 102 is not operating in the hands free mode (for example when a headset is used) then the echo signals might not be significantly received at the microphones $\mathbf{402}_1$, $\mathbf{402}_2$ and $\mathbf{402}_3$ of the microphone array 206 and as such, the changing of the beamformer coefficients to reduce echo (in the echo state) is not needed since there is no significant echo, even though a loudspeaker signal is present.

In the embodiments described above it is the beamformer coefficients themselves which are stored in the memory 214 and which are retrieved in steps S510 and S522. As an example, the beamformer coefficients may be Finite Impulse Response (FIR) filter coefficients, w, describing filtering to be applied to the microphone signals $y_1(t)$, $y_2(t)$ and $y_3(t)$ by the beamformer 404. The coefficients of the FIR filters may be computed using a formula $w=f(G)$ where G is a signal-dependent statistic measure, and $f(\,)$ is a predetermined function for computing the beamformer filter coefficients w therefrom. In some embodiments, rather than storing and retrieving the beamformer filter coefficients w, it is the statistic measure G, that is stored in the memory 214 and retrieved from the memory 214 in steps S510 and S522. The statistic measure G provides an indication of the filter coefficients w. Once the measure G has been retrieved, the beamformer filter coefficients w can be computed using the predetermined function $f(\,)$. The computed beamformer filter coefficients can then be applied by the beamformer 404 to the signals received by the microphones $\mathbf{402}_1$, $\mathbf{402}_2$ and $\mathbf{402}_3$ of the microphone array 206. It may require less memory to store the measure G than to store the filter coefficients w. Furthermore, it may be advantageous from an accuracy and/or performance perspective to perform the averaging on G (rather than on the beamformer filter coefficients w themselves) since this can give a better result. When the measure G is stored in the memory 214, the behavior of the beamformer 404 can be smoothly adapted by smoothly adapting the measure G.

In the embodiments described above the signals processed by the beamformer are audio signals received by the microphone array 206. However, in alternative embodiments the signals may be another type of signal (such as general broadband signals, general narrowband signals, radar signals, sonar signals, antenna signals, radio waves or microwaves) and a corresponding method can be applied. For example, the beamformer state (i.e. the beamformer coefficients) can be retrieved from a memory when the initiation of a particular signal state is determined.

Furthermore, while this invention has been particularly shown and described with reference to preferred embodiments, it will be understood to those skilled in the art that various changes in form and detail may be made without departing from the scope of the invention as defined by the appendant claims.

What is claimed is:

1. A method of processing signals at a device, the method comprising:

receiving signals at a plurality of sensors of the device;

determining the initiation of an echo signal state in which signals including echo signals are received at the plurality of sensors;

responsive to the determining the initiation of the echo signal state, retrieving, from a data store, data indicating beamformer coefficients to be applied by a beamformer of the device, the indicated beamformer coefficients being determined so as to be suitable for application to the signals received at the sensors in the echo signal state; and the beamformer applying the indicated beamformer coefficients to the signals received at the sensors in the echo signal state to generate a beamformer output.

2. The method of claim 1 wherein prior to the initiation of the echo signal state the device operates in a non-echo signal state in which the beamformer applies other beamformer coefficients which are suitable for application to the signals received at the sensors in the non-echo signal state, and wherein the method further comprises storing the other beamformer coefficients in the data store responsive to the determining the initiation of the echo signal state.

3. The method of claim 2 further comprising:

determining the initiation of the non-echo signal state;

responsive to determining the initiation of the non-echo signal state, retrieving, from the data store, data indicating the other beamformer coefficients; and the beamformer applying the indicated other beamformer coefficients to the signals received at the sensors in the non-echo signal state, thereby generating the beamformer output.

4. The method of claim 3 further comprising, responsive to the determining the initiation of the non-echo signal state, storing, in the data store, data indicating the beamformer coefficients applied by the beamformer prior to the initiation of the non-echo signal state.

5. The method of claim 1 wherein the sensors are microphones for receiving audio signals and wherein the device comprises an audio output block for outputting audio signals in a communication event, wherein the audio signals are echo audio signals output from the audio output block in the echo signal state.

6. The method of claim 2 wherein the non-echo signal state is a state in which echo audio signals are not significantly received at the sensors wherein the sensors are microphones.

7. The method of claim 1 wherein the determining the initiation of the echo signal state is performed before the echo signal state is initiated.

8. The method of claim 5 wherein the determining the initiation of the echo state comprises determining output activity of the audio output block in the communication event.

9. The method of claim 1 wherein the determining the initiation of the echo signal state comprises determining that echo signals are received at the sensors.

10. The method of claim 1 wherein the beamformer applying the indicated beamformer coefficients comprises smoothly adapting the beamformer coefficients applied by the beamformer until they match the indicated beamformer coefficients.

11. The method of claim 1 wherein the beamformer applying the indicated beamformer coefficients comprises performing a weighted sum of an old beamformer output determined using old beamformer coefficients which were applied by the beamformer prior to the determining the initiation of the echo signal state, and a new beamformer output determined using the indicated beamformer coefficients.

12. The method of claim 11 further comprising smoothly adjusting the weight used in the weighted sum, such that the weighted sum smoothly transitions between the old beamformer output and the new beamformer output.

13. The method of claim 1 further comprising adapting the beamformer coefficients based on the signals received at the sensors such that the beamformer applies suppression to undesired signals received at the sensors.

14. The method of claim 1 wherein the data indicating the beamformer coefficients is the beamformer coefficients.

15. The method of claim 1 wherein the retrieved data indicating the beamformer coefficients comprises a measure of the signals received at the sensors, wherein the measure is related to the beamformer coefficients using a predetermined function.

16. The method of claim 15 further comprising computing the beamformer coefficients using the measure included in the retrieved data and the predetermined function.

17. The method of claim 16 further comprising smoothly adapting the measure to thereby smoothly adapt the beamformer coefficients applied by the beamformer.

18. The method of claim 1 further comprising using the beamformer output to represent the signals received at the plurality of sensors for further processing within the device.

19. The method of claim 18 wherein the beamformer output is used by the device in a communication event.

20. The method of claim 1 further comprising applying echo cancellation to the beamformer output.

21. The method of claim 1 wherein the signals are one of: audio signals, general broadband signals, general narrowband signals, radar signals, sonar signals, antenna signals, radio waves, or microwaves.

22. A device for processing signals, the device comprising:

a beamformer;

a plurality of sensors for receiving signals; and a processing system configured to perform operations comprising:

determining the initiation of an echo signal state in which signals including echo signals are received at the plurality of sensors; and retrieving from a data store, responsive to the determining the initiation of the echo signal state, data indicating beamformer coefficients to be applied by the beamformer, the indicated beamformer coefficients being determined so as to be suitable for application to the signals received at the sensors in the echo signal state;

the beamformer configured to perform operations comprising:

applying the indicated beamformer coefficients to the signals received at the sensors in the echo signal state; and generating a beamformer output.

23. The device of claim 22 further comprising the data store.

24. The device of claim 22 wherein the sensors are microphones for receiving audio signals and the device further comprising an audio output block for outputting audio signals in a communication event, wherein the echo signals are echo audio signals output from the audio output block in the echo signal state.

25. The device of claim 22 further comprising an echo canceller configured to be applied to the beamformer output.

26. A beamformer for processing signals received at a plurality of signal sensors, the beamformer configured to:

receive signals from the plurality of sensors;

determine the initiation of an echo signal state in which signals including echo signals are received at the plurality of sensors;

responsive to the determination of the initiation of the echo signal state, retrieve, from a data store, data indicating beamformer coefficients to be applied, the indicated beamformer coefficients being determined so as to be suitable for application to the signals received at the sensors in the echo signal state; and apply the indicated beamformer coefficients to the signals received at the sensors in the echo signal state to generate a beamformer output.

* * * * *